US006338610B1

(12) United States Patent
Harada et al.

(10) Patent No.: US 6,338,610 B1
(45) Date of Patent: Jan. 15, 2002

(54) CENTRIFUGAL TURBOMACHINERY

(75) Inventors: Hideomi Harada; Shin Konomi, both of Fujisawa (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/600,237

(22) PCT Filed: Jan. 13, 1999

(86) PCT No.: PCT/JP99/00077

§ 371 Date: Jul. 13, 2000

§ 102(e) Date: Jul. 13, 2000

(87) PCT Pub. No.: WO99/36701

PCT Pub. Date: Jul. 22, 1999

(30) Foreign Application Priority Data

Jan. 14, 1998 (JP) ..... 10-017898

(51) Int. Cl.[7] ..... F04D 29/38

(52) U.S. Cl. ..... 416/186 R; 416/223 B

(58) Field of Search ..... 416/185, 186 R, 416/188, 223 B

(56) References Cited

U.S. PATENT DOCUMENTS

| | | | | |
|---|---|---|---|---|
| 5,639,217 A | * | 6/1997 | Ohtsuki et al. | 146/188 |
| 5,685,696 A | | 11/1997 | Zangeneh et al. | 416/186 R |
| 6,135,716 A | * | 10/2000 | Billdal et al. | 416/186 R |

FOREIGN PATENT DOCUMENTS

| | | |
|---|---|---|
| JP | 57-84394 | 11/1955 |
| JP | 54-45801 | 4/1979 |
| JP | 60-29840 | 7/1985 |
| JP | 61-33963 | 8/1986 |
| JP | 62-35100 | 2/1987 |
| JP | 6-307390 | 11/1994 |

OTHER PUBLICATIONS

M. Zangeneh, "A Compressible Three–Dimensionsl Design Method For Radial and Mixed Flow Turbomachinery Blades," International Journal of Numerical in Fluids, vol. 13, 1991, pp. 599–624.

* cited by examiner

*Primary Examiner*—John Kwon
(74) *Attorney, Agent, or Firm*—Armstrong, Westerman, Hattori, McLeland & Naughton, LLP

(57) ABSTRACT

The present invention provides a centrifugal turbomachinery having a good performance which can effectively reduce the secondary flow in the flow passage of the impeller and minimize the loss caused by the secondary flow without an excessive increase in manufacturing cost. An impeller has a plurality of blades (3) between an inlet **(6*a*) at a central portion and an exit (6*b*) at a peripheral portion, and a flow passage formed between the blades for delivering fluid from the impeller inlet to the impeller exit by rotation the impeller. The blade (3) is leaned toward a circumferential direction so that the blade at the hub side (2) precedes the blade at the shroud side (4)** in a rotational direction of the impeller. A blade lean angle, defined as an angle between the blade and a surface perpendicular to a hub surface as viewed from the direction of the exit, shows a decreasing tendency from the inlet to the exit. A blade centerline at the hub side and a blade centerline at the shroud side as viewed from the front direction at the inlet intersect at a point where non-dimensional radius location, defined as a ratio of the radius of the intersection to the radius of the impeller exit, ranges from 0.8 to 0.95.

4 Claims, 9 Drawing Sheets

F / G. 5
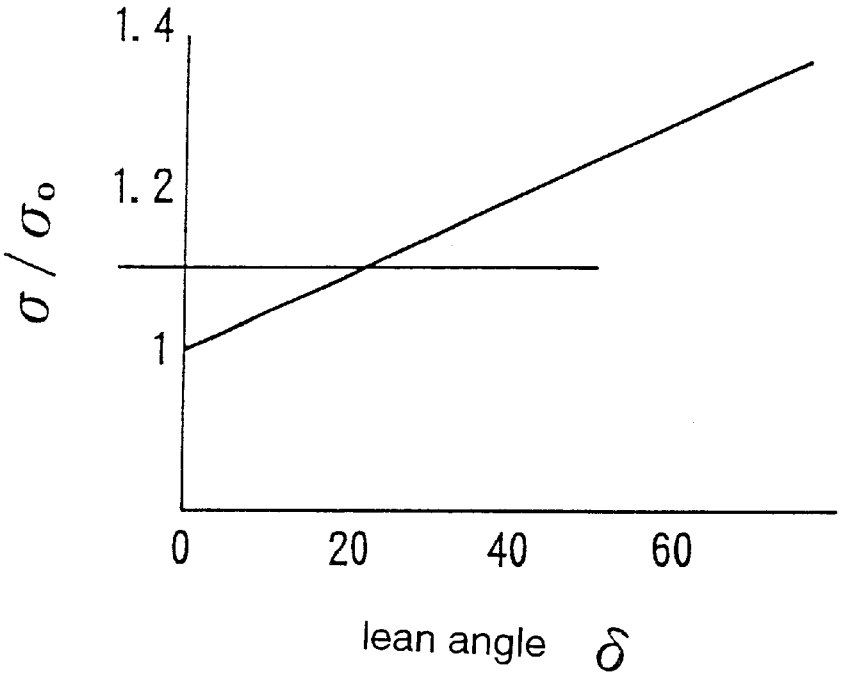
F / G. 6
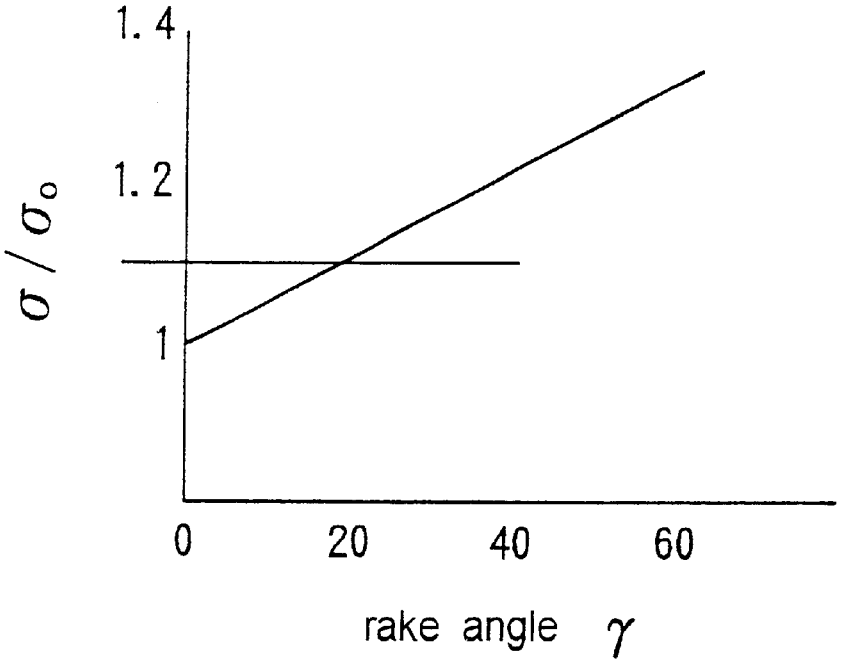

CENTRIFUGAL TURBOMACHINERY

TECHNICAL FIELD

The present invention relates to an improvement in an impeller incorporated in a machine generally called turbomachinery such as a centrifugal pump for pumping liquid, or a blower or a compressor for pressurizing and delivering gas.

BACKGROUND ART

FIGS. 9A through 10B show a typical turbomachinery which is constructed by accommodating an impeller 6 having a hub 2, a shroud 4, and a plurality of blades 3 between the hub 2 and the shroud 4 in a casing (not shown in the drawings) having pipes and by coupling a rotating shaft 1 connected to a driving source to the impeller 6. In such an impeller, the blade tips 3*a* of the blades 3 are covered with a shroud surface 4*a,* and a flow passage is defined by two blades 3 in confrontation with each other, a hub surface 2*a* and the shroud surface 4*a*.

When the impeller 6 is rotated about an axis of the rotating shaft 1 at an angular velocity ω, fluid flowing into the flow passage from an impeller inlet 6*a* through a suction pipe is delivered toward an impeller exit 6*b,* and then discharged to the outside of the turbomachinery through a discharge pipe or the like. In this case, the surface facing the rotational direction of the blade 3 is the pressure surface 3*b,* and the opposite side of the pressure surface 3*b* is the suction surface 3*c*.

The three-dimensional geometry of a closed type impeller as an example of impellers is schematically shown in FIGS. 9A through 10B in such a state that most part of the shroud surface is removed. In the case of an open type impeller, there is no independent part for forming the shroud surface 4, but a casing (not shown in the drawings) for enclosing the impeller 6 serves mechanically as the shroud surface 4. Therefore, there is no basic fluid dynamical difference between the open type impeller and the closed type impeller. Thus, only an example of the closed type impeller will be described below.

In the flow passages of such an impeller in a centrifugal turbomachinery, besides main flow flowing along the flow passages, secondary flows (flow having a velocity component perpendicular to that of the main flow) are generated by movement of low energy fluid in boundary layers on wall surfaces due to pressure gradients in the flow passages. The secondary flow affects the main flow intricately to form vortices or flow having non-uniform velocity in the flow passage, which in turn results in substantial fluid energy loss not only in the impeller but also in the diffuser or guide vanes downstream of the impeller. The total energy loss caused by the secondary flows is referred to as secondary flow loss. It is known that the low energy fluid in the boundary layers accumulated at a certain region in the flow passage due to the secondary flows causes a flow separation in a large scale, thus producing positively sloped characteristic curve and hence preventing the stable operation of the turbomachinery.

The secondary flow in the impeller is broadly classified into the blade-to-blade secondary flow generated along the shroud surface or the hub surface, and the meridional component of the secondary flow generated along the pressure surface or the suction surface of the blades. It is known that the blade-to-blade secondary flow can be minimized by making the blade profile to be backswept. Regarding the other type of the secondary flow, that is, the meridional component of the secondary flow, it is necessary to optimize the three-dimensional geometry of the flow passage, otherwise the meridional component of the secondary flow cannot be weakened or eliminated easily.

The mechanism of generation of the meridional component of the secondary flow is explained as follows: As shown in FIG. 9B, with regard to the relative flow in the flow passage, the reduced static pressure distribution, defined as $p^*$ ($=p-0.5\rho u^2$), is formed by the action of a centrifugal force $W^2/R$ based on the streamline curvature of the main flow and by the action of Coriolis force $2\omega W\theta$ based on the rotation of the impeller, where W is the relative velocity of the flow, R is the radius of streamline curvature, ω is the angular velocity of the impeller, Wθ is the component in the circumferential direction of W relative to the rotating shaft 1, p is the static pressure, ρ is the density of fluid, u is the peripheral velocity at a certain radius from the rotating shaft 1.

The reduced static pressure $p^*$ has a distribution in which the pressure is high at the hub side and low at the shroud side, so that the pressure gradient balances the centrifugal force $W^2/R$ and the Coriolis force $2\omega W\theta$ which are directed toward the hub side shown in FIG. 9B. In the boundary layer along the blade surface, since the relative velocity W is reduced by the influence of the wall surface, the centrifugal force $W^2/R$ and the Coriolis force $2\omega W\theta$ which act on the fluid in the boundary layer become small. Accordingly, the centrifugal force and the Coriolis force cannot balance the reduced static pressure distribution $p^*$ of the main flow. As a result, the low energy fluid in the boundary layer flows towards an area of the low reduced static pressure $p^*$, thus generating the meridional component of the secondary flow along the blade surface from the hub side toward the shroud side, on the pressure surface 3*b* or the suction surface 3*c* of the blade 3. In FIG. 9A, the meridional component of the secondary flow is shown by the dashed arrows on the pressure surface 3*b* of the blade 3 and the continuous arrows on the suction surface 3*c* of the blade 3.

The meridional component of the secondary flow is generated on both surfaces of the suction surface 3*c* and the pressure surface 3*b* of the blade 3. In general, since the boundary layer on the suction surface 3*c* is thicker than that on the pressure surface 3*b,* the secondary flow on the suction surface 3*c* has a greater influence on performance characteristics of a turbomachinery.

When the low energy fluid in the boundary layer moves from the hub side to the shroud side, fluid flow flowing from the shroud side toward the hub side is formed at the midpoint location between two blades to compensate for fluid flow rate which has moved. As a result, as shown schematically in FIG. 10A, a pair of vortices having a different swirl direction from each other is formed in the flow passage between two blades. These vortices are referred to as secondary vortices. Low energy fluid in the flow passage is accumulated due to these vortices at a certain location of the impeller where the reduced static pressure $p^*$ is low, and mixed with fluid which flows steadily in the flow passage, resulting in generation of great flow loss.

Furthermore, if the non-uniform flow generated by insufficient mixing of low energy fluid having a low relative velocity and high energy fluid having a high relative velocity is discharged to the downstream flow passage of the blades, then great flow loss is generated. Such a non-uniform flow leaving the impeller makes the velocity triangle unfavorable at the inlet of the diffuser and causes a separated flow on diffuser vanes or a reverse flow within a vaneless diffuser, resulting in substantial decrease of the overall performance of the turbomachinery.

Therefore, as shown in FIGS. 11A and 11B, in order to optimize the distribution of the reduced static pressure p* in the impeller, it is considered to design the impeller as follows: The blade is leaned toward a circumferential direction, between the location of non-dimensional meridional distance m=0 (impeller inlet) and the location of non-dimensional meridional distance m=1.0 (impeller exit), so that the blade at the hub side precedes the blade at the shroud side in a rotational direction of the impeller. Further, the blade lean angle, defined as an angle between a surface perpendicular to the hub surface and the blade centerline on the cross-sectional view of the flow passage in the impeller, shows a decreasing tendency as the non-dimensional meridional distance m increases.

According to the impeller having the above structure, since the blade is leaned toward a circumferential direction so that the blade at the hub side precedes the blade at the shroud side in a rotational direction of the impeller, a force having a component toward the shroud surface 4 acts on the fluid, the reduced static pressure p* in the flow passage has a higher value at the shroud surface and a lower value at the hub surface 2 to balance the component of the force toward the shroud surface. Further, since the blade lean angle shows a decreasing tendency as the non-dimensional meridional distance m increases, the effect of the blade lean is higher than that in the case where the blade at the shroud side is leaned toward the circumferential direction.

However, in the conventional technology having the above structure, as shown in FIG. 11A, since an angle between a line connecting the center of the blade at the shroud side and the center of the blade at the hub side and a surface perpendicular to the hub surface as viewed from the direction of the impeller exit (rake angle $\gamma$) is extremely large, the blade is deformed by the rotation of the impeller so as to be raised, causing a large bending stress at the blade base.

Further, as shown in FIGS. 11A and 11B, at the impeller inlet, since an angle between a line connecting the center of the blade at the shroud side and the center of the blade at the hub side and a line connecting the center of the blade at the hub side and the center of the impeller (lean angle $\delta$) is formed, the blade is deformed by the rotation of the impeller so as to be raised, causing a large bending stress at the blade base. Further, in the case of a closed type impeller having a cover at the shroud side of the impeller, complicated stresses are caused at various portions of the blade due to formation of the lean angle and the rake angle.

In the case where the impeller is manufactured by welding, the blade base is a part of the welded structure. Accordingly, insufficient welding tends to be caused by the leaned blades, initiating cracks on the welded portion due to rotation and causing a breakdown. Further, since the large stress at the blade base affects the useful life of the impeller, a high degree of welding technology and a high-quality material are required to thus raise manufacturing cost. In the case where the blades are manufactured by mechanical cutting, complicated working is required for mechanical cutting to thus raise manufacturing cost.

DISCLOSURE OF INVENTION

The present invention has been made in view of the above drawbacks. It is therefore an object of the present invention to provide a centrifugal turbomachinery having a good performance which can effectively reduce the secondary flow in the flow passage of the impeller and minimize the loss caused by the secondary flow without an excessive increase in manufacturing cost.

According to a first aspect of the present invention, there is provided an impeller having a plurality of blades between an inlet at a central portion and an exit at a peripheral portion, and a flow passage formed between the blades for delivering fluid from the inlet to the exit by rotation of the impeller, characterized in that: the blade is leaned toward a circumferential direction so that the blade at the hub side precedes the blade at the shroud side in a rotational direction of the impeller at an exit side; a blade lean angle, defined as an angle between the blade and a surface perpendicular to a hub surface as viewed from the direction of the exit of the flow passage, shows a decreasing tendency from the inlet to the exit; and a blade centerline at the hub side and a blade centerline at the shroud side as viewed from the front direction at the inlet intersect at a point where non-dimensional radius location, defined as a ratio of the radius of the intersection to the radius of the exit, ranges from 0.8 to 0.95.

According to another aspect of the present invention, there is provided a turbomachinery having a rotatable impeller incorporated in a casing, the impeller having a plurality of blades between an inlet at a central portion and an exit at a peripheral portion, and a flow passage formed between the blades for delivering fluid from the inlet to the exit by rotation of the impeller, characterized in that: the blade is leaned toward a circumferential direction so that the blade at the hub side precedes the blade at the shroud side in a rotational direction of the impeller at an exit side; a blade lean angle, defined as an angle between the blade and a surface perpendicular to a hub surface as viewed from the direction of the exit of the flow passage, shows a decreasing tendency from the inlet to the exit; and a blade centerline at the hub side and a blade centerline at the shroud side as viewed from the front direction at the inlet intersect at a point where non-dimensional radius location, defined as a ratio of the radius of the intersection to the radius of the impeller exit, ranges from 0.8 to 0.95.

The hub, the shroud, and the blade may be integrally formed of metal.

BRIEF DESCRIPTION OF DRAWINGS

FIG. 1A is a meridional view and FIG. 1B is a front view;

FIG. 2A is a meridional view and FIG. 2B is a front view;

FIG. 3A is a meridional view and FIG. 3B is a front view;

FIG. 4A is a meridional view and FIG. 4B is a front view;

FIG. 5 is a graph showing the relationship between the lean angle $\delta$ at the blade tip of the impeller inlet and the stress at the blade base of the impeller exit in the closed type impeller;

FIG. 6 is a graph showing the relationship between the rake angle $\gamma$ and the stress at the blade base of the impeller inlet in the closed type impeller;

FIG. 7A is a meridional view and FIG. 7B is a front view;

FIG. 9A is a perspective view and FIG. 9B is a meridional view;

FIG. 10A is a cross-sectional view and FIG. 10B is a front view;

FIG. 11A is a cross-sectional view and FIG. 11B is a front view.

FIG. 12A is a cross-sectional view and FIG. 12B is a front view.

BEST MODE FOR CARRYING OUT THE INVENTION

Figure 1A:
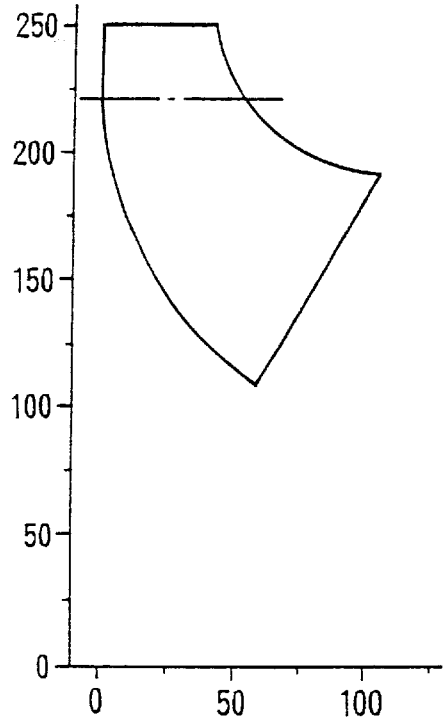
FIGS. 1A and 1B are schematic views showing the blade shape in a turbomachinery according to an embodiment of the present invention.
Figure 1B:
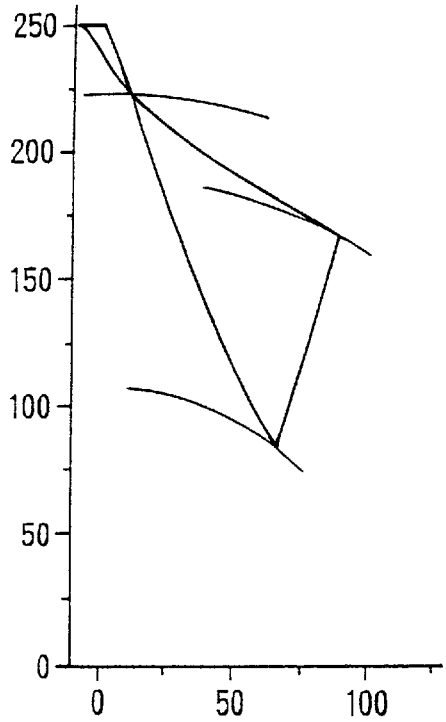
Figure 2A:
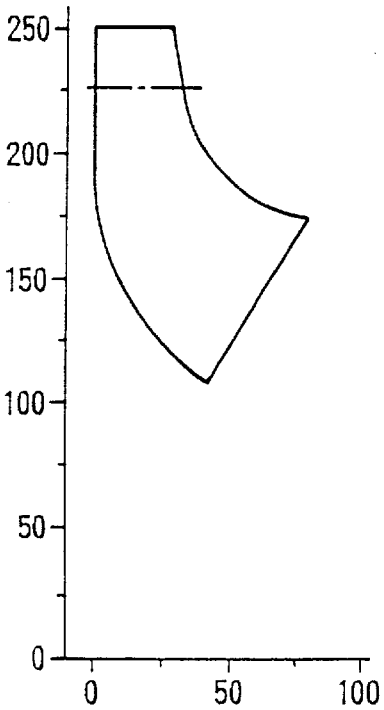
FIGS. 2A and 2B are schematic views showing the blade shape in a turbomachinery according to another embodiment of the present invention.
Figure 2B:
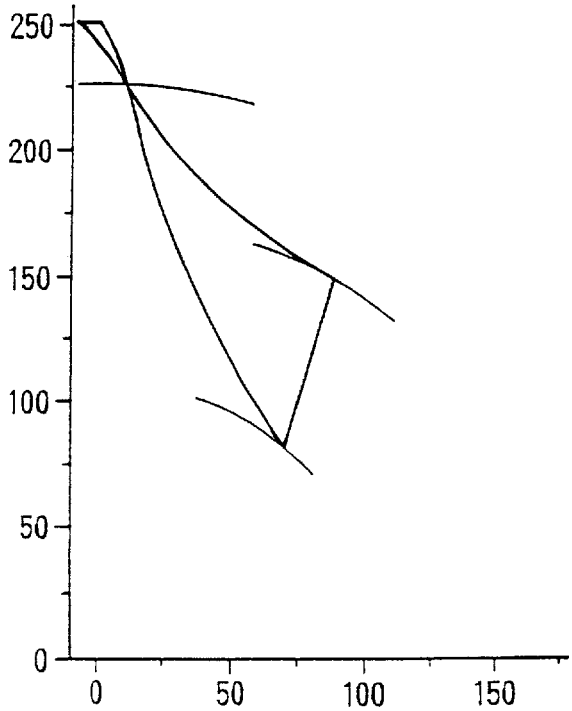
Figure 3A:
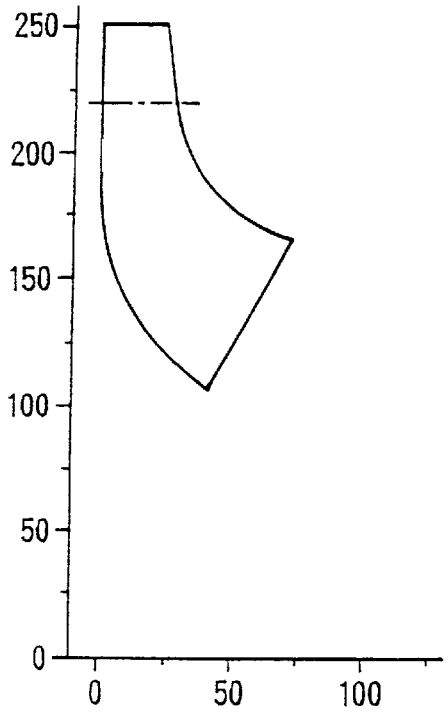
FIGS. 3A and 3B are schematic views showing the blade shape in a turbomachinery according to another embodiment of the present invention.
Figure 3B:
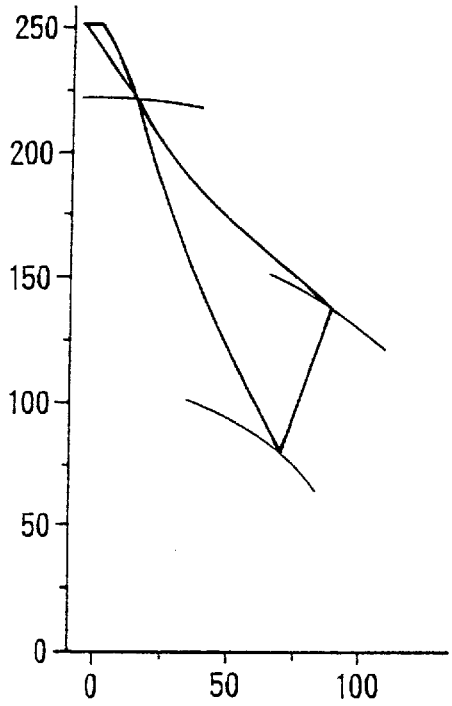
Figure 4A:
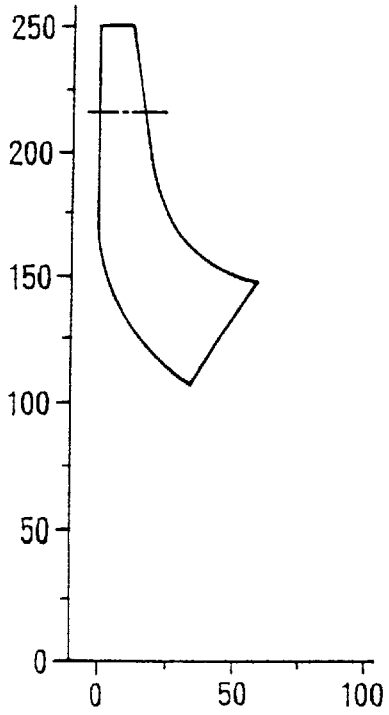
FIGS. 4A and 4B are schematic views showing the blade shape in a turbomachinery according to another embodiment of the present invention.
Figure 4B:
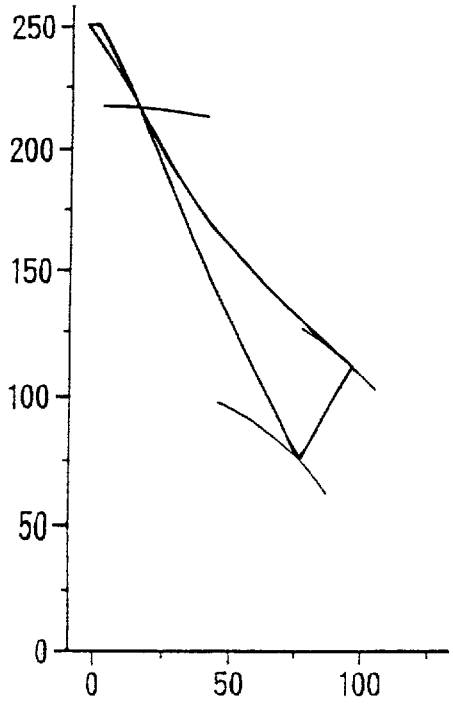

FIGS. 1A through 4B show an impeller according to an embodiment of the present invention. FIGS. 1A and 1B show an impeller having a specific speed of 500, FIGS. 2A and 2B show an impeller having a specific speed of 400, FIGS. 3A and 3B show an impeller having a specific speed of 350, and FIGS. 4A and 4B show an impeller having a specific speed of 250. These impellers are designed based on the concept described below.

Figure 11A:
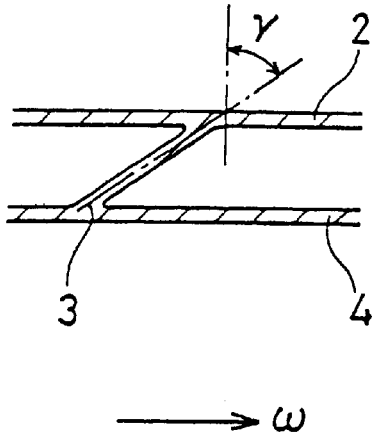
FIG. 11A PRIOR ART
FIGS. 11A and 11B are views showing the blade shape of another impeller in a conventional centrifugal turbomachinery.
Figure 11B:
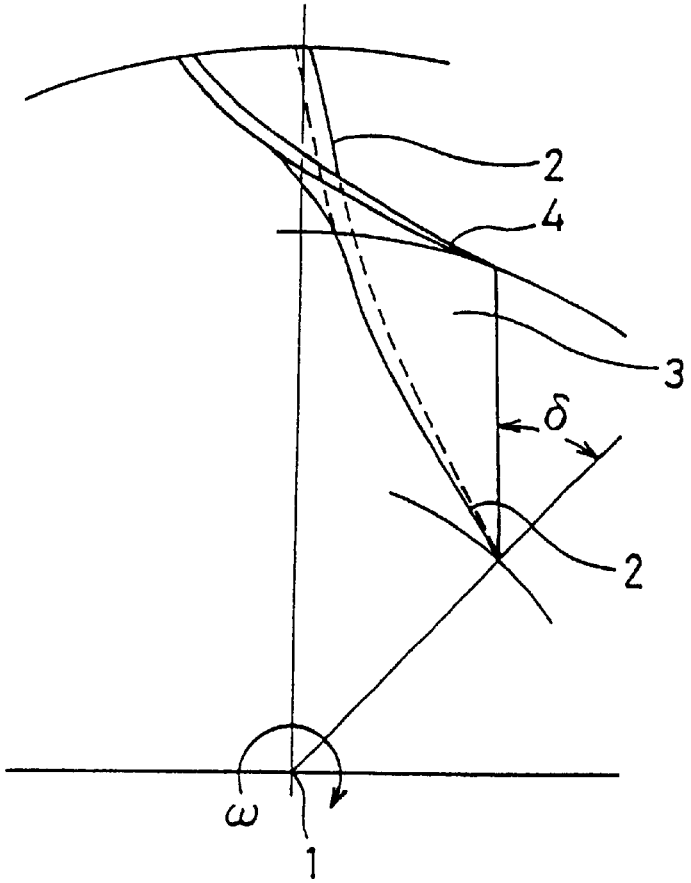
FIG. 11B PRIOR ART
Figure 12A:
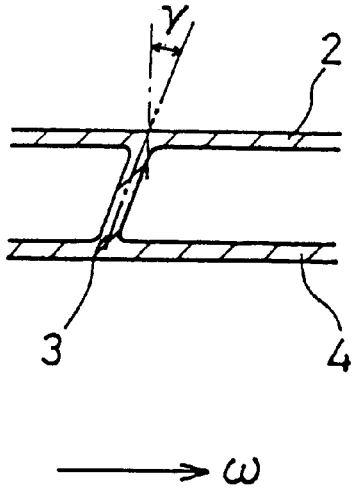
FIG. 12A PRIOR ART
FIGS. 12A and 12B are views showing the blade shape of still another impeller in a conventional centrifugal turbomachinery.
Figure 12B:
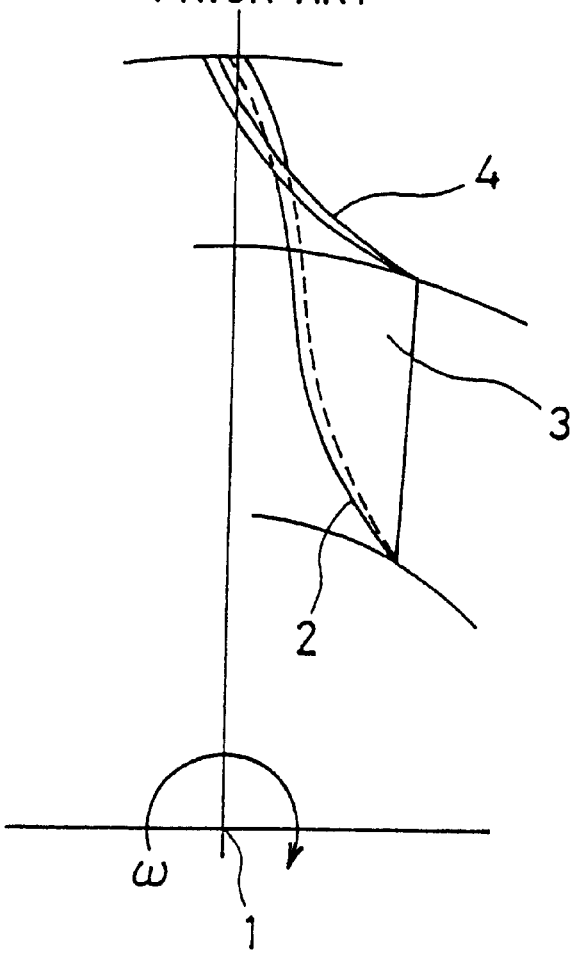
FIG. 12B PRIOR ART

The inventors of the present invention simulated the impeller as shown in FIGS. 11A and 11B with changing several parameters to suppress the excessive lean of the blade. The simulations was carried out based on the impeller in which the blade was leaned toward a circumferential direction so that the blade at the hub side precedes the blade at the shroud side in a rotational direction of the impeller and the blade lean angle, defined as an angle between the blade center line and a surface perpendicular to the hub surface on the cross-section of the flow passage in the impeller, showed a decreasing tendency as the non-dimensional meridional distance m increases. It was considered that as a maximum of the blade lean angle, an angle at which 110% of the stress developed at the lean angle of zero degree was developed was adequate.

FIG. 5 is a result of the calculation of the stress acting at the blade base of the impeller exit side on the basis of the lean angle of zero degree, the horizontal axis representing the lean angle $\delta$ defined as an angle between a line connecting the center of the blade at the shroud side and the center of the blade at the hub side and a line connecting the center of the blade at the hub side and the center of the impeller, at the blade tip of the closed type impeller inlet. FIG. 5 shows that the stress becomes larger as the lean angle is larger. In FIG. 5, if the allowable stress of the blade is assumed to be 110% of the stress developed at the lean angle of zero degree, the limitation of the lean angle is 25 degrees.

In FIG. 6, the horizontal axis represents the rake angle $\gamma$ defined as an angle between a line connecting the center of the blade at the shroud side and the center of the blade at the hub side and a surface perpendicular to the hub surface, and the vertical axis represents the stress at the blade base of the impeller inlet. FIG. 6 shows that the stress becomes larger as the rake angle is larger. In FIG. 6, if the allowable stress of the blade is assumed to be 110% of the stress developed at the rake angle of zero degree, the limitation of the rake angle is 20 degrees.

Figures 7A, 7B:
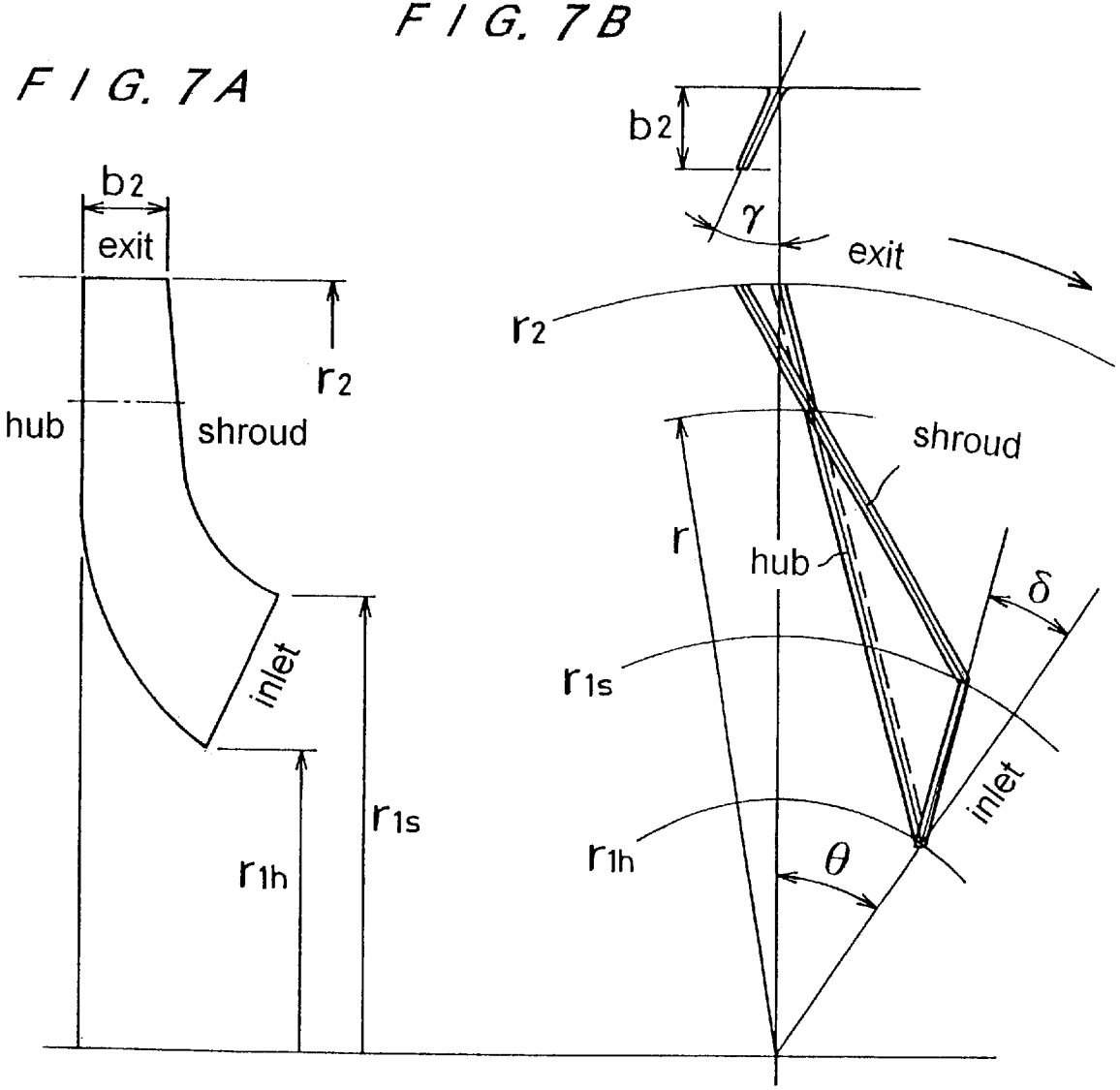
FIGS. 7A and 7B are schematic views showing the shape of the impeller as a simulation model for analysis.

As described above, if the rake angle and the lean angle of the blade are determined, the schematic blade shape is determined. FIGS. 7A and 7B show the impeller shape as a simulation model for further analysis, and FIG. 7A is a meridional view and FIG. 7B is a front view. In the front view, for the sake of simplification, straight lines are drawn between the impeller inlet and the impeller exit at each of the hub side and the shroud side. Since the actual blade shape is depicted by curves, it is different from the shape shown in FIG. 7B.

As is apparent from FIGS. 7A and 7B, in the impeller having such a shape that the blade at the hub side precedes the blade at the shroud side in a rotational direction of the impeller at the impeller exit, a line connecting the impeller inlet and the impeller exit at the hub side and a line connecting the impeller inlet and the impeller exit at the shroud side intersect at one point.

From the above description, it is estimated that if the lean angle and the rake angle are larger, this intersection becomes nearer to the impeller inlet. The inventors of the present invention manufactured impellers having different specific speeds under the precondition of $\delta<25$, $\gamma<20$, and analyzed by measuring the shapes and sizes of some impellers that have a high efficiency.

Figure 8:
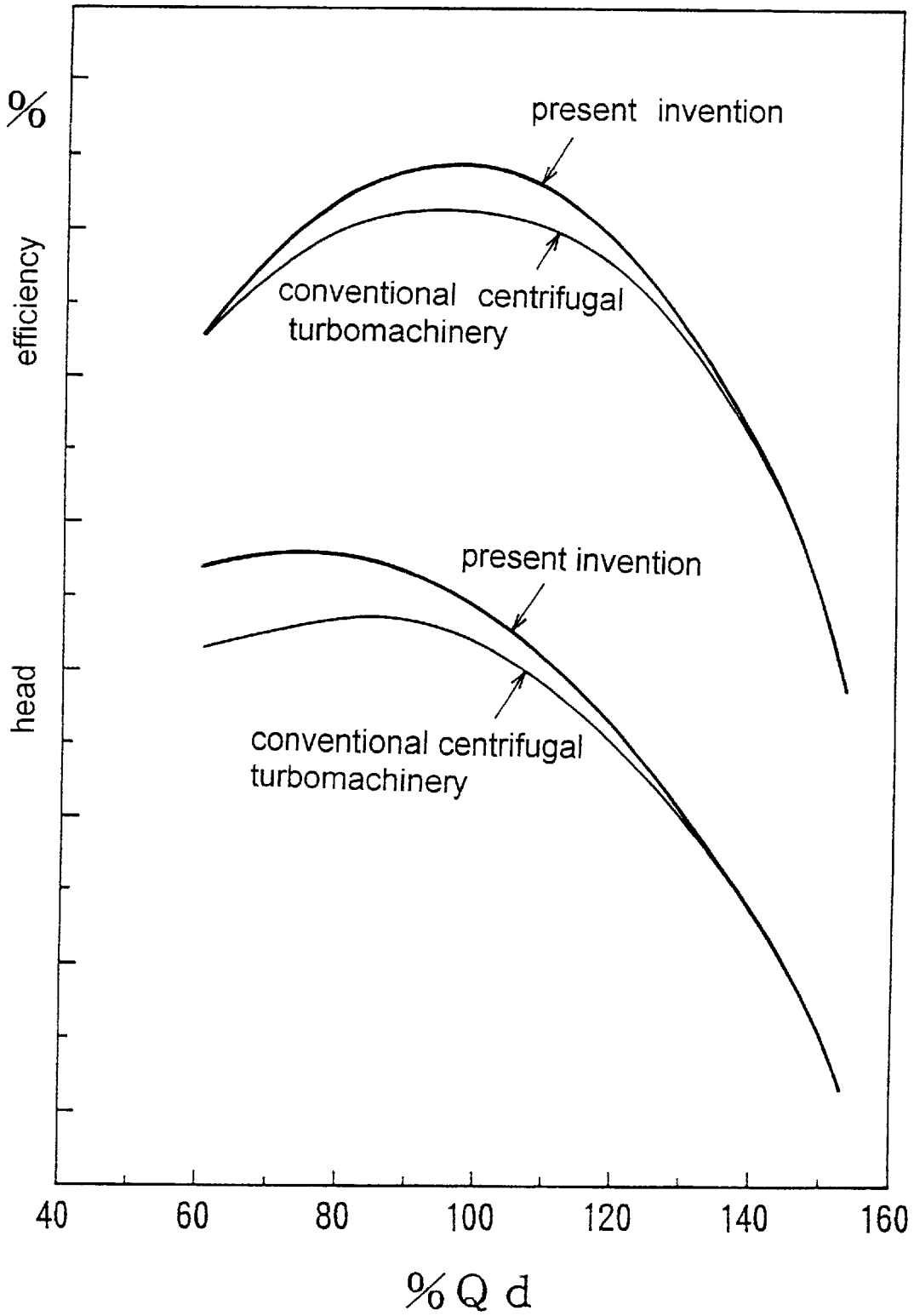
FIG. 8 is a graph showing the result of an experiment in which the impeller having the shape according to the present invention is mounted on the stage of the compressor.
Figure 9A:
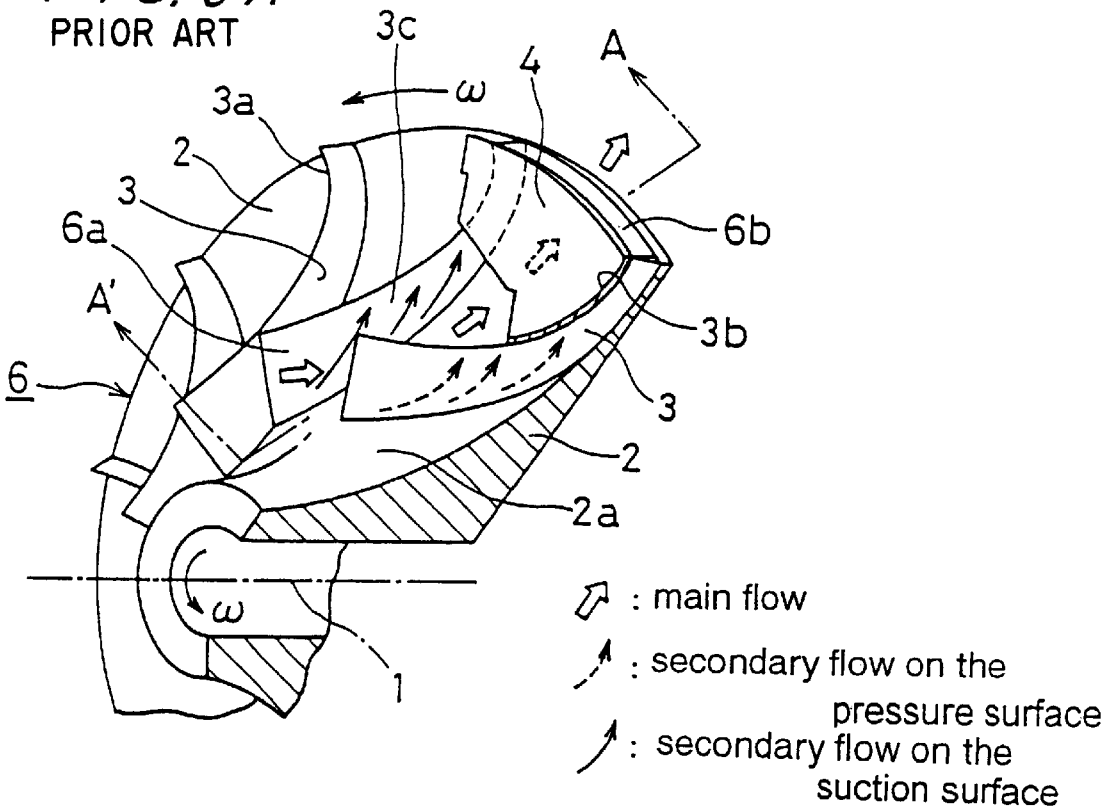
FIG. 9A PRIOR ART
FIGS. 9A and 9B are views showing the shape of the impeller in a conventional centrifugal turbomachinery.
Figure 9B:
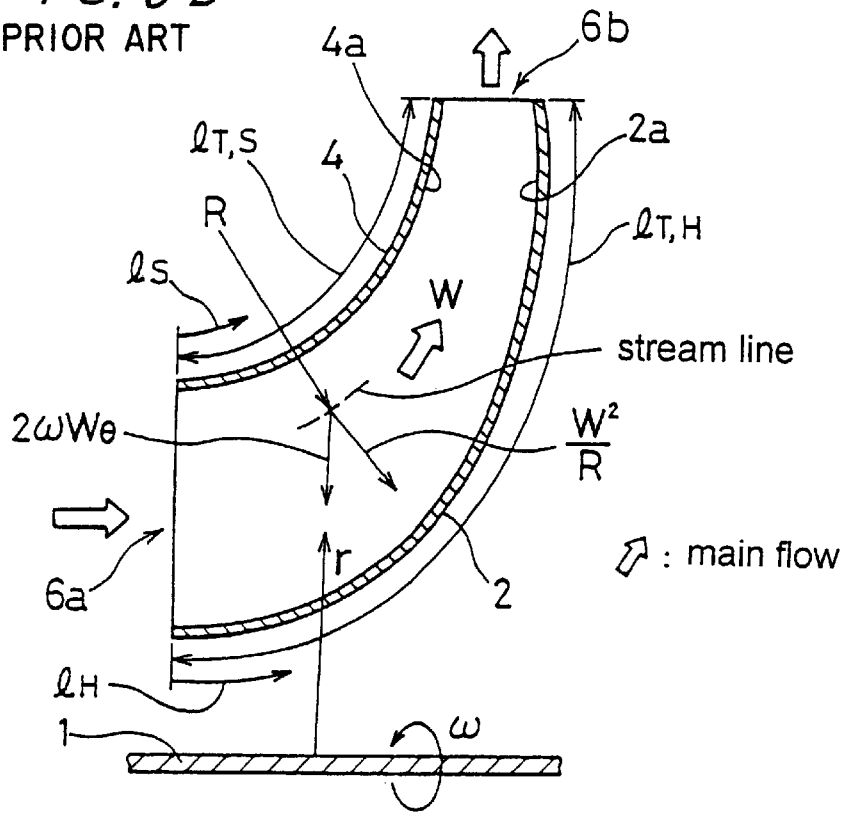
FIG. 9B PRIOR ART
Figure 10A:
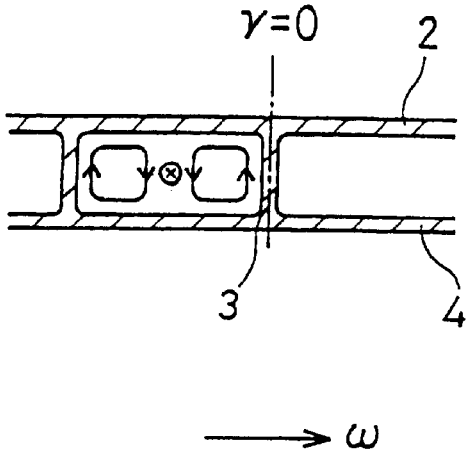
FIG. 10A PRIOR ART
FIGS. 10A and 10B are views showing the blade shape of the impeller in a conventional centrifugal turbomachinery.
Figure 10B:
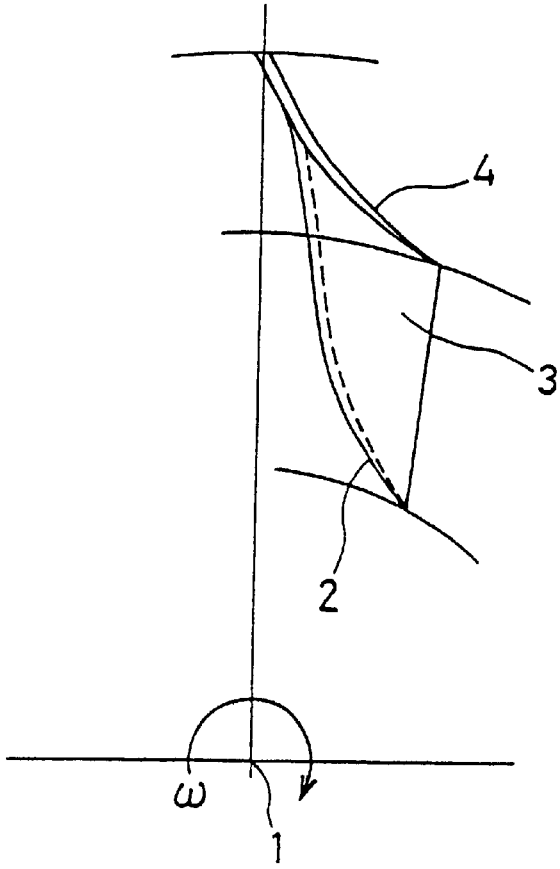
FIG. 10B PRIOR ART

FIGS. 1A through 4B are front views and meridional views showing the impellers having different specific speeds which are developed by the inventors of the present invention. As is apparent from these drawings, a blade centerline at the hub side and a blade centerline at the shroud side intersect at a point near the impeller exit as shown in the front views of the impeller. It is confirmed that the intersection is located in the range of 0.8 to 0.95 in the non-dimensional radius location, defined as a ratio of the radius of the intersection to the radius of the impeller exit. FIG. 8 shows the results in the experiments in which the impeller having the shape according to an example of the present invention is mounted on the stage of the compressor. It is confirmed that the impeller according to the present invention has a performance which is remarkably superior to the impeller having the conventional shape.

As described above, according to the present invention, there is provided a centrifugal turbomachinery having a good performance which can effectively reduce the secondary flow in the flow passage of the impeller and minimize the loss caused by the secondary flow without an excessive increase in manufacturing cost.

Industrial Applicability

The present invention has a great utility value in industry by being applied to an impeller incorporated in a machine generally called turbomachinery such as a centrifugal pump for pumping liquid, or a blower or a compressor for pressurizing and delivering gas.

What is claimed is:

1. An impeller having a plurality of blades between an inlet at a central portion and an exit at a peripheral portion, and a flow passage formed between said blades for delivering fluid from said inlet to said exit by rotation of said impeller, characterized in that:

said blade is leaned toward a circumferential direction so that the blade at the hub side precedes the blade at the shroud side in a rotational direction of said impeller;

a blade lean angle, defined as an angle between said blade and a surface perpendicular to a hub surface as viewed from the direction of said exit of said flow passage, shows a decreasing tendency from said inlet to said exit; and a blade centerline at the hub side and a blade centerline at the shroud side as viewed from the front direction at said inlet intersect at a point where non-dimensional radius location, defined as a ratio of the radius of said intersection to the radius of said exit, ranges from 0.8 to 0.95.

2. A turbomachinery having a rotatable impeller incorporated in a casing, said impeller having a plurality of blades between an inlet at a central portion and an exit at a peripheral portion, and a flow passage formed between said blades for delivering fluid from said inlet to said exit by rotation of said impeller, characterized in that:

said blade is leaned toward a circumferential direction so that the blade at the hub side precedes the blade at the shroud side in a rotational direction of said impeller at an exit side;

a blade lean angle, defined as an angle between said blade and a surface perpendicular to a hub surface as viewed from the direction of said exit of said flow passage, shows a decreasing tendency from said inlet to said exit; and a blade centerline at the hub side and a blade centerline at the shroud side as viewed from the front direction at said inlet intersect at a point where non-dimensional radius location, defined as a ratio of the radius of said intersection to the radius of said impeller exit, ranges from 0.8 to 0.95.

3. An impeller according to claim 1, wherein the hub, the shroud, and the blade are integrally formed of metal.

4. A turbomachinery according to claim 2, wherein the hub, the shroud, and the blade are integrally formed of metal.

* * * * *